US005492163A

United States Patent [19]

Allendörfer

[11] Patent Number: 5,492,163

[45] Date of Patent: Feb. 20, 1996

[54] MOUNTING FOR A SLIDING SHUTTER

[76] Inventor: Erich Allendörfer, Rheinfelser Strasse 81-85, D-35398 Giessen-Lützellinden, Germany

[21] Appl. No.: 246,066

[22] Filed: May 19, 1994

[30] Foreign Application Priority Data

May 21, 1993 [DE] Germany ..... 43 17 080.3

[51] Int. Cl.[6] ..... E06B 9/26

[52] U.S. Cl. ..... 160/32; 160/133

[58] Field of Search ..... 160/23.1, 26, 32, 160/33, 133, 38

[56] References Cited

U.S. PATENT DOCUMENTS 2,428,644 10/1947 Zega ..... 160/23.1
3,961,659 6/1976 Siegel ..... 160/23.1
4,168,734 9/1979 Holmqvist et al. ..... 160/23.1
4,197,896 4/1980 Reichstadt ..... 160/26
4,234,032 11/1980 Stark ..... 160/26
5,067,540 11/1991 Besler ..... 160/23.1

*Primary Examiner*—David M. Purol
*Attorney, Agent, or Firm*—Flynn, Thiel, Boutell & Tanis

[57] ABSTRACT

The design of sliding shutter boxes for sliding shutters on windows, door openings and the like requires in most cases the off site assembly of the entire mounting. Furthermore, such sliding shutter boxes are often very large and heavy and thus unnecessarily burden the building. The invention therefore provides to use a self-supporting housing of sheet-metal parts, which can be preassembled and can be installed on site together with the drum needed for rolling up the sliding shutter, the sliding shutter itself and other parts.

21 Claims, 4 Drawing Sheets

FIG. 6
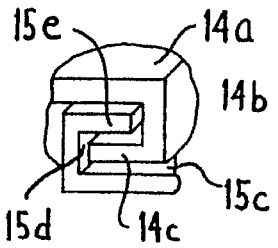
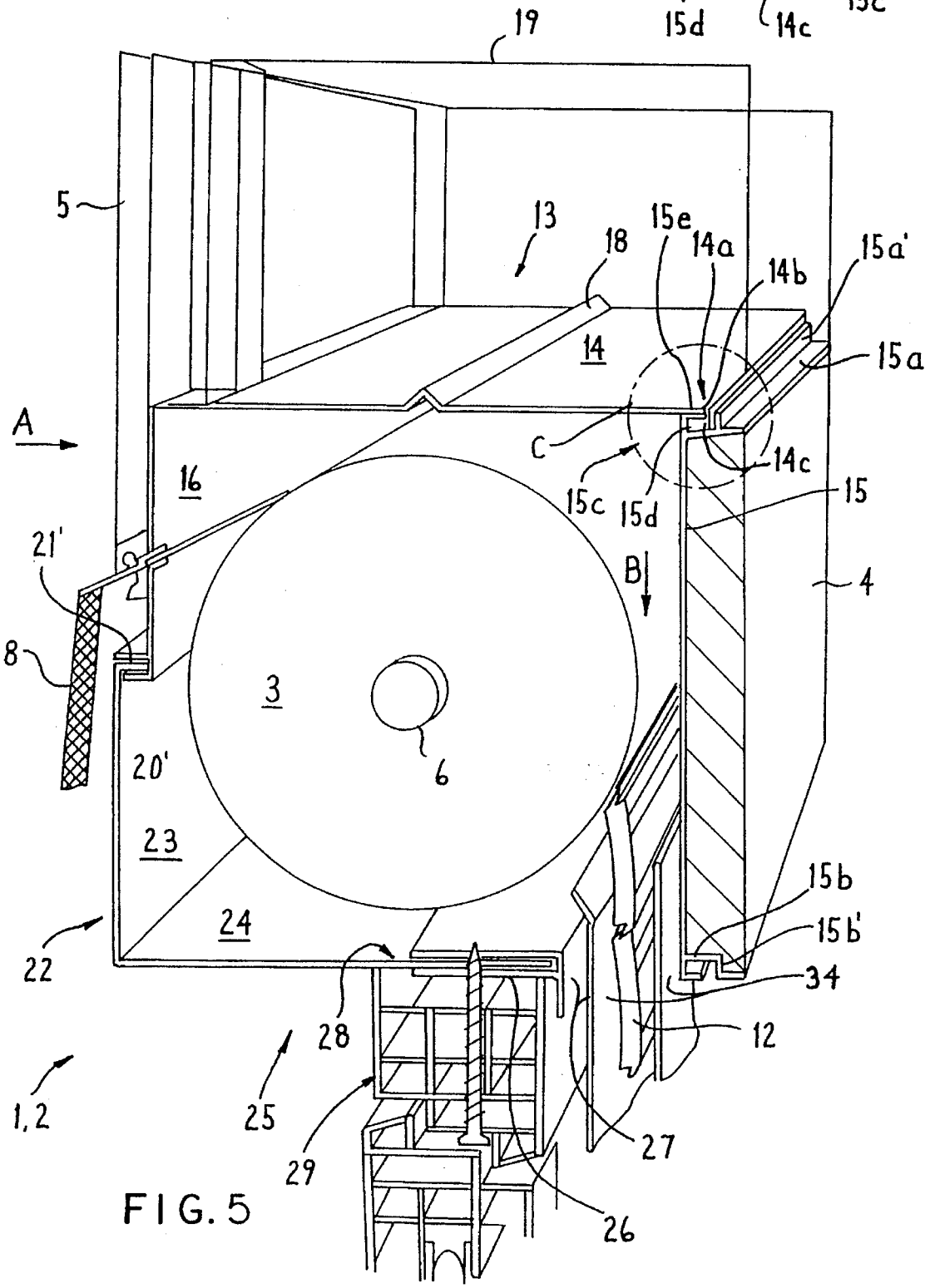
FIG. 5

MOUNTING FOR A SLIDING SHUTTER

FIELD OF THE INVENTION

The invention relates to a mounting for a sliding shutter for windows or similar building openings, which sliding shutter can be wound onto a drum and consists of a plurality of horizontal segments, and more particularly a square-shaped sliding shutter box for mounting above a window and means for guiding and securing the sliding shutter unwound from the drum.

BACKGROUND OF THE INVENTION

Such sliding shutters are largely used for closing off window openings, doors of private and business establishments and the like. Conventional shutter boxes which receive the drum consist at least of several individual parts, which are assembled earlier off site and are adjusted at the site to fit the respective installation conditions. In particular, when buildings equipped with such sliding shutters are of a light-weight construction, at times significant problems arise during the installation of the sliding shutter box because of the applied loads related thereto. On the other hand, the usually provided guide for the unwound sliding shutter is often not sufficient to withstand the force of wind so that damage to the sliding shutter is unavoidable.

The purpose of the invention is therefore to design a mounting of the type identified in detail above such that the structural elements, on the one hand have a sufficiently high stability against elastic and plastic deformation, and on the other hand the entire shutter box construction, because of its low weight, puts very little load stress on the building equipped with same.

SUMMARY OF THE INVENTION

The purpose is attained according to the invention by providing a multi-part sliding shutter box housing mounted above a window or the like and means for guiding and securing a sliding shutter unrolled from a drum rotatably supported within the housing.

The housing is designed to be self-supporting and does not require any reinforcements so that the entire sliding shutter box can be premanufactured and can be installed in an assembled state on the window or a comparable building opening. This significantly reduces the installation costs. The inventive continuous reinforcements of the usually long strips of housing parts guarantee in spite of the relatively light construction a great stiffness of the sliding shutter box. Also, the accessibility of the inside of the sliding shutter box containing the drum and the conventional belt-driven drive roller is still guaranteed in a simple manner. Access to the inside of the shutter box is obtained by removing a corner cover piece.

The lateral guide means for the unwound sliding shutter is fastened in an economical manner together with a vertical portion of the window frame to a sidewall of the building defining the opening. This measure also contributes significantly to the permanent arrangement of the guide. The unwound, vertical flat sliding shutter panel is thus secured in a simple manner against bending by anchoring rods which can be installed when needed so that the panel cannot leave the lateral guide means.

BRIEF DESCRIPTION OF THE DRAWINGS

The invention will be discussed in greater detail hereinafter in connection with one exemplary embodiment and the drawings, in which:

FIG. 5 is a partial perspective view taken from one end of a sliding shutter box according to a second embodiment of the invention; and FIG. 6 is an enlarged cross sectional plan view of a corner construction of the shutter box illustrated in FIG. 5.

DETAILED DESCRIPTION

Figure 1:
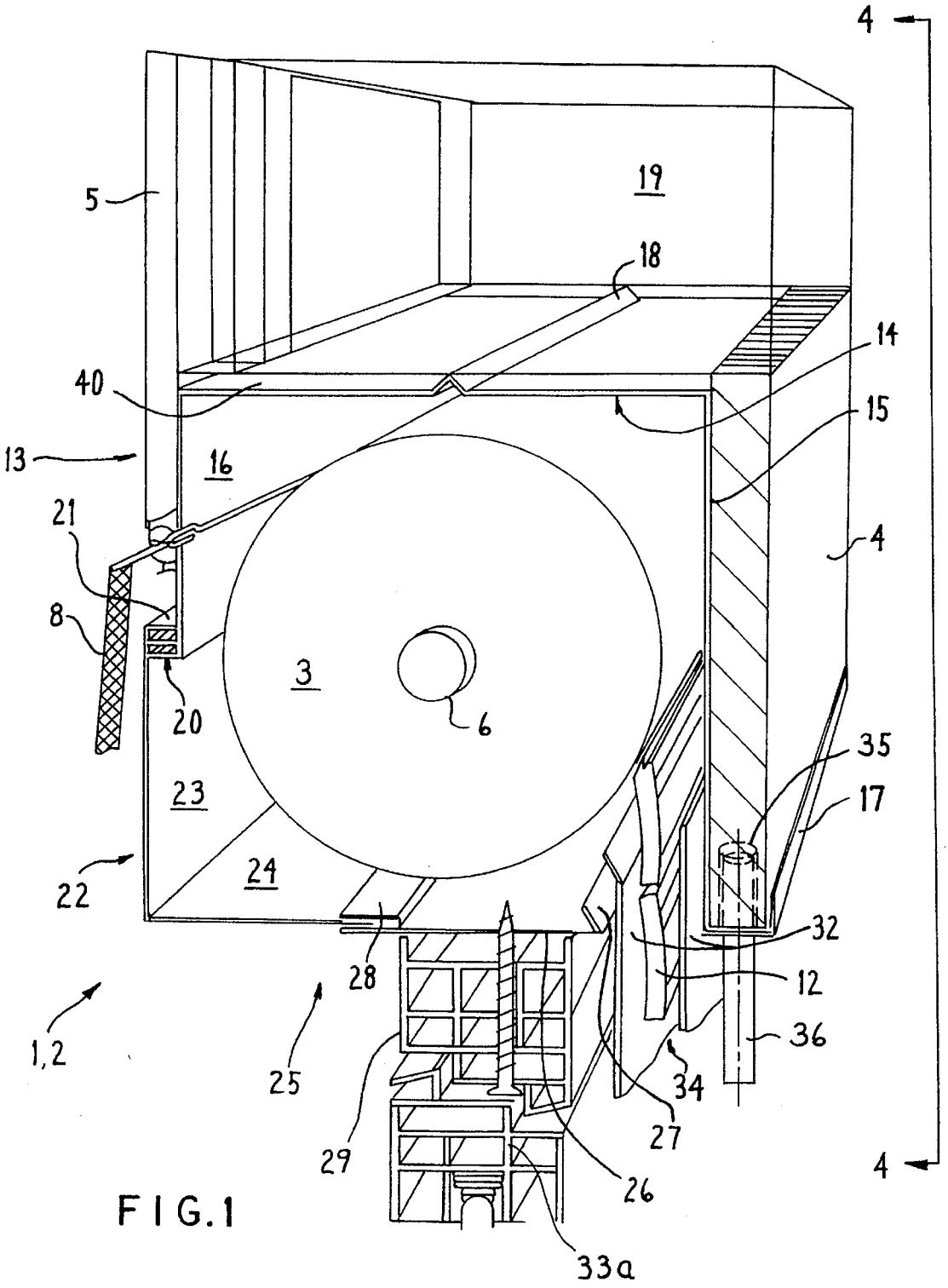
FIG. 1 is a partial perspective view taken from one end of a sliding shutter box according to the first embodiment of the present invention.
Figure 2:
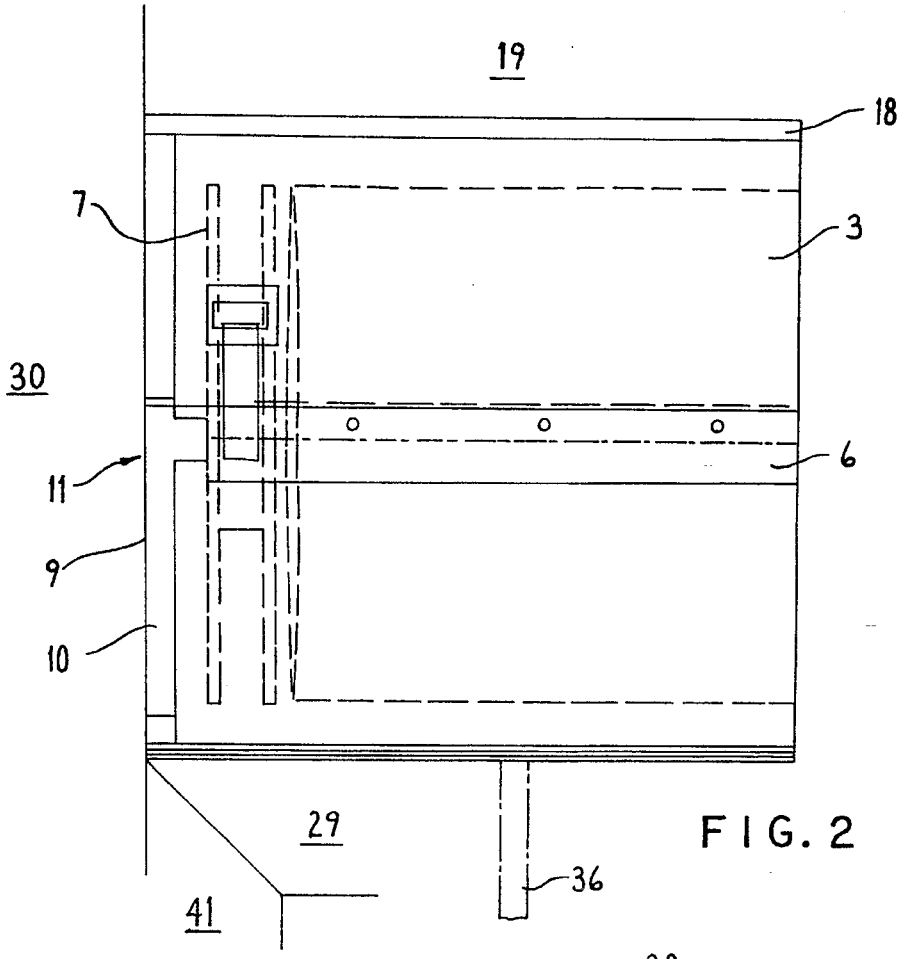
FIG. 2 is an enlarged cross sectional plan view of an end/portion of the shutter box illustrated in FIG. 4.

A sliding shutter box 1 as shown FIGS. 1 and 2 consists of an elongate housing 2 for a drum 3, an exterior facing cover plate 4 and an interior facing protective plate 5. The drum 3 is provided on an axle 6, on which is also provided a belt roller 7 for a belt 8. Bearing points 11 for the axle 6 exist in each of two sheet- metal end parts 9 (one shown) on the sides of the housing 2, which end parts are covered by reinforcing plates 10 provided inside of the housing 2. Two segments of a sliding shutter 12, which are unwound from the drum 3, are indicated in FIG. 1.

The housing 2 consists of sheet-metal parts and includes an upper part 13 having an upper cover piece 14, an exterior cover piece 15 and an interior cover piece 16. The cover pieces 15 and 16 are angled downwardly from the upper cover piece 14 and end in continuous edges. An outwardly and upwardly directed L-shaped lower edge 17 of the exterior cover piece 15 is used to receive a lower portion of the cover plate 4 which is attached to the exterior piece 15. The upper cover piece 14 is reinforced with a bead 18 over its entire length, which bead extends into a gap 40 between a window head 19 (illustrated in outline form) and the upper cover piece 14. Bead 18 serves to reinforce the cover piece 14 and serves to seal off the gap 40 between the upper cover piece 14 and the window head 19. Since the housing 2 is not connected to the window head 19, the gap 40 can be created due to heat expansions and other movements of the building. The window head 19 can be designed in such a manner that the bead 18 engages a matching recess in an underside thereof. The interior cover piece 16 includes an inwardly directed flange 20 positioned approximately at half of the height of the housing 2, which flange 20 is covered by an outwardly directed flange 21 of a corner cover piece 22. The corner cover piece 22 consists of a vertical part 23, which has the flange 21, and a horizontal part 24. The corner cover piece 22 belongs to a divided lower part 25 which is complementary to the upper part 13 and has in addition, a horizontal frame piece 26. The end edges of the frame piece 26 and the upper part 13 are rigidly connected to each end part 9 in a manner which, in the installed state, does not permit a quick release of this connection. The corner cover piece 22 is arranged easily releasably from the upper part 13 and 13 and horizontal frame piece. The corner cover piece 22 is, in the area of the flanges 20 and 21, screwed to the interior cover piece 16, with the space defined between the flanges 20 and 21 being filled with a suitable material, for example a wood molding in order to simplify the screwed connection. The frame piece 26 includes an upwardly extending flange 27 formed in an exterior edge thereof to guide the unrolling sliding shutter 12, and a first guiding channel 28 formed in an interior edge of the frame piece 26 to receive an edge of the horizontal part 24 of the corner cover piece 22.

Figure 3:
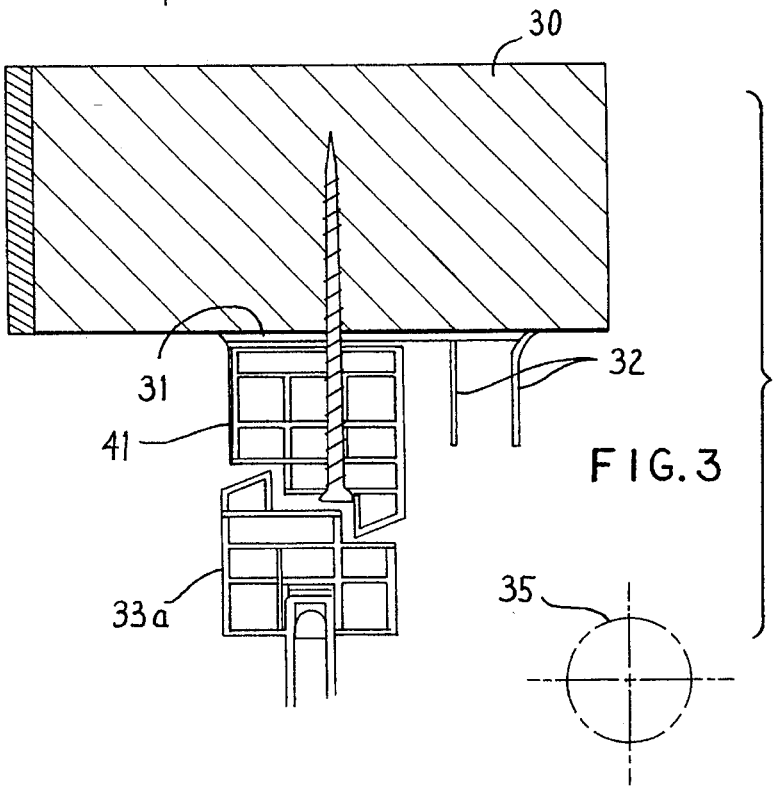
FIG. 3 is a partial top view of a window and window taken along the line 3—3 of FIG. 4.

FIG. 1 also shows that the upper, horizontal part 29 of a window frame is fastened to the frame piece 26, when the housing 2 is oriented stationarily. Each of the end parts 9 are fastened to the window wall 30 with fastening means 43. According to FIG. 3, the vertical parts 41 of the window frame are fastened to a base plate 31 resting against the window wall 30, which base plate is furthermore provided integral with the vertical guide 32 of the sliding shutter 12. It can be recognized that the installation of the window frame together with the window 33 and integral support frame 33*a* is very simple, in particular when the base plate 31 is already premounted on the window frame vertical parts 41.

The frame piece 26 is spaced with its flange 27 from the exterior cover piece 15 so that a slot-shaped opening 34 results, through which pass both the guide 32 and the unrolled sliding shutter 12.

Figure 4:
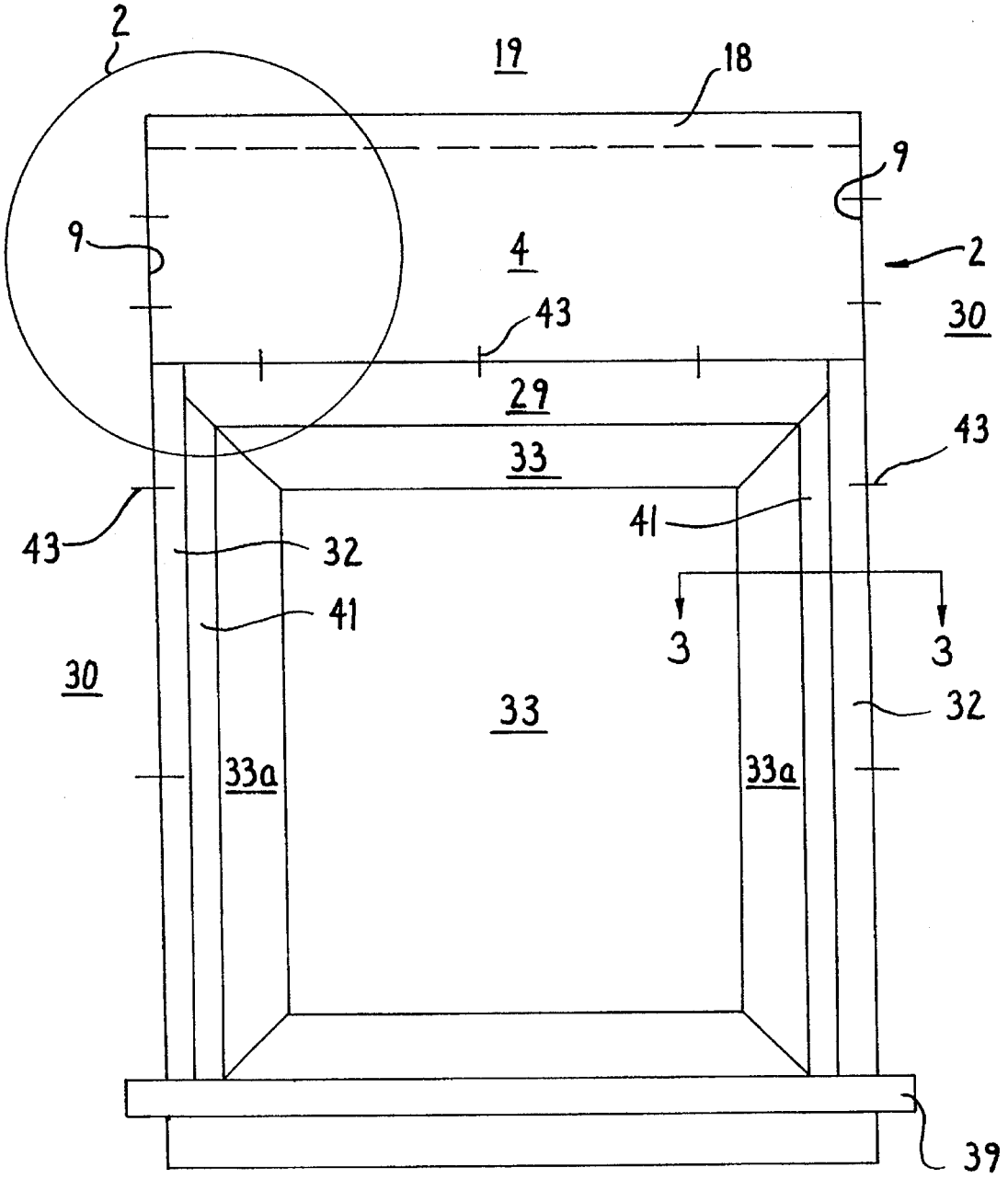
FIG. 4 is a partial elevational view of the shutter box and window frame taken along the line 4—4 of FIG. 1.

Coaxial recesses 35 are provided through a portion of the cover plate 4 and the window sill 39 (FIG. 4) of the window 33, into which recesses 35 anchoring rods 36 can be inserted. The anchoring rods 36 are used when the danger exists that the unrolled, flat sliding shutter 12 will bend so far under the force of wind that either the segments break or the sliding shutter is pressed out of the guide 32. It can happen under the force of wind that the sliding shutter is not only pressed inwardly but also outwardly. The anchoring rods 36 prevent a bending to the outside, just like the window prevents a bending to the inside.

A slightly modified embodiment is shown in FIGS. 5 and 6, in which the housing parts now consist of pieces so that complicated edge solutions can be created without any additional cost, which solutions enable a yet faster mounting and demounting. The already described parts, which have been taken over essentially unchanged from FIG. 1, have in FIGS. 5 and 6 the same reference numerals.

In contrast to the arrangement consisting of sheet-metal parts, the housing parts are now manufactured using an extrusion method. The interior cover piece 16 is thereby first provided at its lower end with a second guiding channel 20', into which a tab 21' at the upper end of the corner cover piece 22 is inserted. The first and second guide channels 20' and 28 are oriented in the same plane to facilitate removal and installation of the corner cover piece 22. The corner cover piece 22 can in this manner be easily removed and does not cause any damage even when the protective plate 5 and/or the other surroundings are plastered.

The upper cover piece 14 is releasably connected to the exterior cover piece 15. The cover plate 4 is held or elastically clamped to the exterior cover piece 15 by holding members 15*a* and 15*b* provided along the entire top and bottom edges of the exterior cover piece 15. The holding members 15*a* and 15*b* are reinforced over their entire length with reinforcing flanges 15*a'* or 15*b'*.

The exterior cover piece 15 and the upper cover piece 14 each include complementary hook-shaped flanges 14*a* and 15*c* along adjacent edges thereof. Both flanges 14*a*, 15*c* are constructed such that they can be placed hookingly into engagement with one another. Flanges 14*a*, 15*c* each form guiding grooves 14*b*, 15*d* into which the end tabs 14*c* 15*e* of the respective housing parts 14, 15 can be inserted. The flanges 14*a*, 15*c* are designed such that they can be easily separated from one another so that the cover plate 4 together with the exterior cover piece 15 can be easily removed. The construction suffices without any connecting elements.

The L-shaped edge 17, bead 18, flange 27, first and second guiding channels 20', 28, overlapping flanges 20, 21, holding members 15*a*, 15*b*, end tabs 14*c* 15*e* and the reinforcing flanges 15*a'*, 15*b'*, i.e. all beads, edges, and the like act reinforcingly to provide a great stiffness to the sliding shutter box.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A window-and-shutter assembly adapted for instillation in an opening formed in a wall, the opening having a top, opposed sides, a bottom, an interior face and an outer face, said assembly including:

a shutter unit including:

a pair of opposed end plates positioned against the opposed sides of the wall opening adjacent the top of the wall opening;

end plate fasteners for securing said end plates to the adjacent sections of the wall so that when downward forces are imposed on said end plates, said end plates remain secured to the wall;

a shutter drum extending between said end plates that is rotatably attached to said end plates, said shutter drum having a plurality of shutter elements wrapped therearound and a control line connected thereto for controlling the rotation of said drum;

a housing frame attached to and extending between said end plates, said housing frame including a top plate located above said shutter drum adjacent the top of the wall opening, an exterior plate that extends downward from the top plate adjacent the outer face of the opening, and an interior plate that extends downward from said top plate adjacent the interior face of the opening, said top plate being formed with a reinforcing member that extends substantially the length of said top plate;

a bottom plate located below said shutter drum, said bottom plate being attached to and extending between said end plates, said bottom plate being spaced apart from said housing frame exterior plate so as to define a slot through which said shutter elements can travel and being spaced away from said housing frame interior plate so as to define a gap through which bottom and side portions of said shutter drum are accessed;

a cover piece releasably secured to said housing frame interior plate and to said bottom plate so as to selectively cover said shutter drum access gap; and a window unit including:

a frame located outwardly of said shutter unit housing frame interior plate so as to be spaced away from said shutter drum access gap, said frame having a top member secured to said shutter unit bottom plate, side elements located adjacent the wall opening that extend downward from said frame top element and a window sill located adjacent the bottom of the opening;

frame fasteners for securing said frame side elements to the adjacent sections of the wall; and a window element disposed in said window frame.

2. The window-and-shutter assembly of claim 1 further including two pairs of guide members, said pairs of guide members being located adjacent the opposed sides of the wall opening and extending downwardly from said slot through which said shutter elements pass, each pair of guide members defining a channel through which adjacent end sections of said shutter elements travel.

3. The window-and-shutter assembly of claim 1, further including two base plates, each said base plate being disposed between one said window frame and the adjacent side of the wall, wherein said window unit frame fastening elements extend through said window frame side elements and said base plates.

4. The window-and-shutter assembly of claim 2, further including two pairs of guide members, each said pair of guide members being attached to one said base plate so as to be located adjacent the opening outer face and defining a channel through which adjacent end section of said shutter elements travel.

5. The window-and-shutter assembly of claim 1, wherein said shutter unit housing frame exterior plate is formed with a bottom portion that has an outwardly extending lip and a cover plate is disposed against said exterior plate so as to be seated on said exterior plate lip.

6. The window-and-shutter assembly of claim 5, wherein said shutter unit housing frame cove plate and said window unit window sill are formed with coaxial recesses and a reinforcing rod is seated in and extends between said recesses along said window unit window frame along the outer face of the window opening in front of said shutter elements.

7. The window-and-shutter assembly of claim 1, wherein said shutter unit housing frame top plate reinforcing member includes an upwardly directed bead dimensioned to abut a portion of the wall defining the top of the opening.

8. The window-and-shutter assembly of claim 1, wherein said shutter unit bottom plate is formed with an upwardly directing flange adjacent said slot defined by said bottom plate and said shutter unit housing frame exterior plate.

9. The window-and-shutter assembly of claim 1, wherein said shutter unit bottom plate is formed with channel open toward interior face of the opening and said cover piece is releasably secured in said bottom plate channel.

10. The window-and-shutter unit of claim 1, wherein said shutter unit housing frame interior plate is formed with an outwardly directed horizontal flange, said shutter unit cover piece is formed with a horizontally directed flange positioned to be aligned with aligned with said housing frame interior plate flange and a fastener element is employed to releasably secure said flanges together.

11. The window-and-shutter assembly of claim 1 further including a protector plate releasably secured to said shutter unit housing frame interior plate.

12. The window-and-shutter assembly of claim 1, wherein said shutter unit housing frame top plate and said housing frame interior plate are formed as a one piece unit.

13. The window-and-shutter assembly of claim 1, wherein said shutter unit housing frame top plate and exterior plate are formed as a one piece unit.

14. The window-and-shutter assembly of claim 1, wherein said shutter unit housing frame exterior plate is releasably secured to said housing frame top plate.

15. The window-and-shutter assembly of claim 14, wherein said shutter unit housing frame top plate is formed with a clamping unit and said housing unit exterior plate is formed with a tab positioned to be inserted into and coupled to said top plate clamping unit.

16. A shutter assembly for instillation over a window located in an opening formed in a wall, the opening having a top, opposed sides, an interior face and an outer face, the window being a located in a lower portion of the opening so as to define a gap between said window an the top of the opening, said shutter assembly including:

a shutter housing disposed in said gap, said shutter housing including: a pair of opposed end plates positioned against the opposed sides of the wall opening adjacent the top of the wall opening; a top plate extending between said end plates adjacent the top of the wall, said top plate being formed with at least one reinforcing member that extends substantially the length of said top plate; an exterior plate that extends downward from said top plate adjacent the outer face of the opening; an interior plate that extends downward from said top plate adjacent the interior face of the opening; a bottom plate that extends between and is secured to said end plates, said bottom plate being spaced apart from said exterior plate so as to define an opening therebetween and said bottom plate being spaced apart from said interior plate so as to define an access opening therebetween; and a cover plate releasably secured to said interior plate and said bottom plate so as to selectively close said access opening;

a shutter drum disposed in said housing between said top and bottom plates and being rotatably secured to said end plates, said shutter drum having a plurality of shutter elements wrapped therearound and are positioned to pass between said slot between said housing exterior plate and said housing interior plate;

fastening members attached to said housing end plates for directly securing said end plates to the wall; and fastening members for securing said housing bottom plate to the window.

17. The shutter assembly of claim 16, wherein said shutter housing top plate and said shutter housing interior plate are formed as a one piece unit.

18. The shutter assembly of claim 16, wherein said shutter housing top plate and said shutter housing exterior plate are formed as a one piece unit.

19. The shutter assembly of claim 16, wherein said shutter housing frame exterior plate is releasably secured to said housing frame top plate.

20. The shutter assembly of claim 16, further including two base plates, each said base plate being disposed between the window frame and the adjacent side of the wall and being formed with a pair of spaced apart guide members that extend into said opening between said housing bottom plate and said housing exterior plate, said guide members being spaced apart from each other to form a slot through which adjacent ends of said shutter elements travel.

21. The window-and-shutter assembly of claim 1, wherein said window unit has a selected width and said shutter has a length equal to said width of said window unit so that said assembly has opposed sides with vertical, linear profiles.

* * * * *

UNITED STATES PATENT AND TRADEMARK OFFICE

CERTIFICATE OF CORRECTION

PATENT NO. 5 492 163

DATED February 20, 1996

INVENTOR(S) Erich ALLENDOERFER

It is certified that error appears in the above-indentified patent and that said Letters Patent is hereby corrected as shown below:

Column 5, line 29; change "cove" to ---cover---.

Column 5, line 51; delete "aligned with" (second occurrence).

Column 6, line 6; change "instillation" to ---installation---.

Column 6, line 9; delete "a".

Column 6, line 10; change "an" to ---and---.

Signed and Sealed this

Tenth Day of September, 1996

Bruce Lehman

*Attest:*

BRUCE LEHMAN

*Attesting Officer*

*Commissioner of Patents and Trademarks*